United States Patent [19]

Sexton

[11] 4,441,400

[45] Apr. 10, 1984

[54] SHOTSHELL COMPONENT RECOVERY APPARATUS AND METHOD

[76] Inventor: Larry J. Sexton, 539 Wright St. Bldg. #3, Unit 204, Lakewood, Colo. 80228

[21] Appl. No.: 401,951

[22] Filed: Jul. 26, 1982

[51] Int. Cl.[3] ..... C06B 21/00; F42B 33/10

[52] U.S. Cl. ..... 86/1 A; 86/1 R; 30/90.1

[58] Field of Search ..... 86/1 R, 1 A; 30/90.1

[56] References Cited

U.S. PATENT DOCUMENTS 4,114,266 9/1978 Erpenbeck ..... 30/90.1

*Primary Examiner*—Leland A. Sebastian
*Assistant Examiner*—Joel P. Okamoto
*Attorney, Agent, or Firm*—Jerry W. Berkstresser; Bruce G. Klaas

[57] ABSTRACT

A device and method for safely cutting through the outer body or case of a round of ammunition to recover the internal components thereof by providing a cutting implement on an operable device sized to receive the round when closed and engage the cutting implement.

8 Claims, 6 Drawing Figures

SHOTSHELL COMPONENT RECOVERY APPARATUS AND METHOD

BACKGROUND OF THE INVENTION

This invention relates to loaded shotshells and the components therefore and more particularly to an apparatus and method for separately and safely recovering the contents of a loaded shotshell.

With the increasing popularity of the sport of trap shooting, skeet shooting and upland bird and waterfowl hunting, it has also become an economic necessity for the serious shooter to reload his spent shotshells or hulls. This trend has grown rapidly as the cost of powder, petroleum based plastic shotcups or wads, and lead has risen sharply in the past several years. These increases, passed on to the consumer in higher prices for factory loaded shotshells, is also reflected in the higher cost of the components used by the load-your-own group of shooters.

Even though there are many different reloading tools being marketed which do an excellent job of providing safe reliable hand loaded shotshells, there are still a wide variety of variables which are factors in the preparation of a suitable handloaded shotshell. For example, the number of times a hull has been reloaded affects the condition of the hull, which condition will vary depending on its structure, shape and the materials from which it is made. The design, condition and the and the adjustment of the apparatus provided for resizing the base of the shotshell, and for making the crimp at the top of shot chamber are also very important variables which can be responsible for ruining a reloaded shotshell by rendering it unuseable in a gun. Likewise, though many reloading apparatuses are provided with elaborate fail safe devices for preventing the hand loader from erroneously placing shot where power should be or vice versa or even mixing the two in either chamber of the shell reserved for only one component; it is still possible, with often depressing regularity, to create a shotshell which is unuseable for one of the foregoing reasons.

In this situation it has been the practice, before the present invention, for these culls, or bad shells, to be accumulated and eventually either disposed of or cut open to render the shells harmless and/or recover the components. This operation requires the deft use of a pocket knife.

Either improper disposal or the improper use of a knife can produce a potential hazard. Likewise at the trap line or any shooting range, not infrequently, a misfire can occur from either an improperly loaded shotshell, either hand load or factory load, or from a mechanical malfunction of a gun, where it is often necessary to dispose of a live shotshell. This also presents a potentially hazardous situation if not done properly.

It is therefore an object of the present invention to provide a device and a method for safely opening a shotshell to render it harmless and, if desired, to remove and recover the reuseable components therefrom.

DETAILED DESCRIPTION OF THE DRAWINGS

Figures 1, 2:
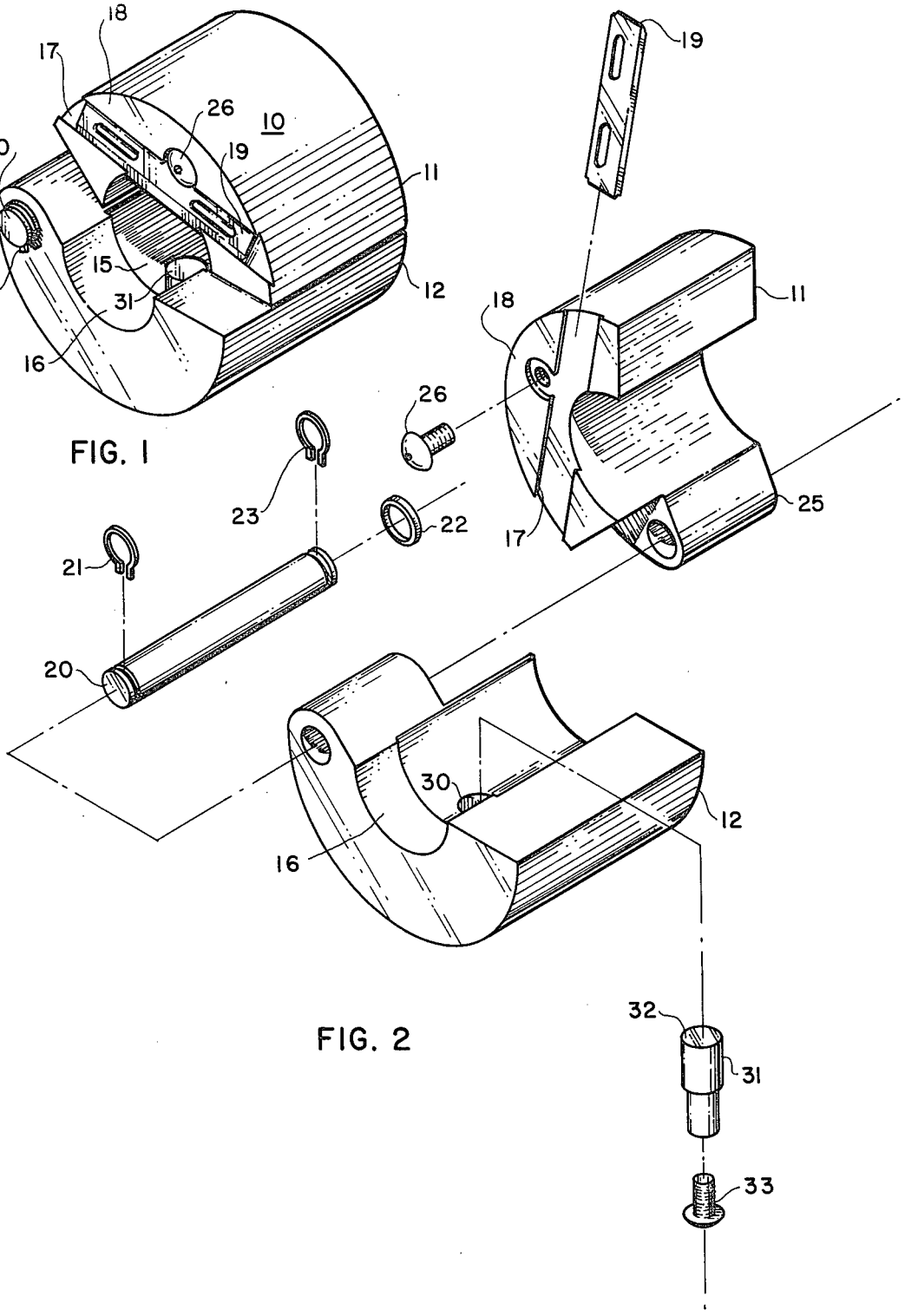
FIG. 1 is an isometric view of the shotshell component recovery apparatus or shotshell opener of the present invention.
FIG. 2 is an exploded view of the apparatus shown in FIG. 1.

The opener 10 is shown in its closed or operative condition in FIG. 1. The opener 10 in the view in FIG. 1 include two semi-cylindrical sections designated as a smaller cutting section 11 and a larger shoulder-containing section 12. The opener 10 in its closed position, as shown in FIG. 1, defines a bore 15 of one predetermined diameter sized to freely receive the largest diameter dimension of a shot shell of a preselected guage. When closed as shown in FIG. 1 the larger shoulder-containing section 12 contains a surface 16 which defines a semi-circular portion of a cylindrical bore generally coaxial with the bore 15, which is sized to rotatably receive that portion of a shotshell which is received in the chamber of the breech of a gun. The two sections 11 and 12 are configured and bored to form a hingelike assemblage through which a hinge pin 20 is received for rotating one section away from and toward the other. The hinge pin 20 extends beyond the face of each section and is grooved to receive slip rings, such as shown at 21 to maintain the position and function of the hinge pin 20.

The face 18 of the section 11 which is proximate to the shoulder surface 16, on the larger shoulder-containing section 12, is flat and generally perpendicular to the axis of the bore 15. A recess 17 is cut into the face 18 of the section 11 and the recess 17 is sized to receive a cutting implement 19. In the preferred embodiment of the present invention, the cutting emplement 19 can be standard commercial razor blade or the like and the recess 17 is cut deeply enough to accomodate the thickness of the preselected blade and provide that one exposed flat surface of the blade is flush with the face 18 of section 11. The location of the recess 17 across the face 18 is likewise preselected in combination with the selected cutting implement 19 to provide that a portion of the cutting implement extends into the bore 15 a sufficient depth to extend through the wall thickness of any shotshell placed in the bore when the two sections 11, and 12 are brought together around hinge pin 20 into abutment to form the generally cylindrical configuration shown in FIG. 1.

The preferred configuration for the previously identified elements of the structure are clearly shown in the exploded view of FIG. 2. In addition to the foregoing, a bushing 22 is provided to be received on hinge pin 20 between slip ring 23 and the rear face of section 11 at 25 to insure a snug but rotatable bearing for the hinging movement of section 11 with respect to section 12 about the hinge pin 20 received in the registering holes (not numbered) in sections 11 and 12 (shown in FIG. 2).

In addition, the cutting implement 19 when received in the recess 17 on face 18 of section 11 is firmly fastened in the desired location by means of fastener 26 which in the preferred embodiment shown is threadably received in section 11 so as to bear on a portion of the implement 19, holding it in the recess 17 during the operation of the opener 10.

As will be more fully described hereinafter, the section 12 is also provided with a bore 30 located in the side wall of the bore 15 at a predetermined location beyond the inner terminus of surface 16. The axis of bore 30 and bore 15 are generally perpendicular. In the preferred embodiment shown the bore 30 is counterbored to have a larger diameter nearest the wall of bore 15 and a smaller diameter toward the exterior surface (not numbered) of section 12. This configuration is provided to receive locating pin 31, also provided with two diameters to be completely received in the bore 30 so that the face 32 of the locating pin 31 does not protrude sufficiently into the bore 15 to interfer with the operation of the opener when the brass end of a shotshell is properly inserted into the bore 15 as will be more fully described hereinafter. The length of the locating pin 31 is preselected to extend beyond the outer surface of section 12 a predetermined distance. The locating pin 31 is provided with a threaded recess axially at its smaller diameter end (not shown) to receive a threaded stop 33. When the locating pin 31 is received in the bore 30 so that its face 32 is generally flush with the wall of bore 15 the threaded stop 33 is affixed to the protruding end of locating pin 31 so that the pin 31 can be caused to move a limited distance into the bore 15 and withdrawn when desired. The length of the pin 31 beyond the outside of the section 12, which determines the location of the stop 33 will define the extent to which pin 31 can be made to invade the interior space inside the bore 15. A typical location of the pin 31 when extended into the bore 15 is shown in FIG. 1.

Figure 3:
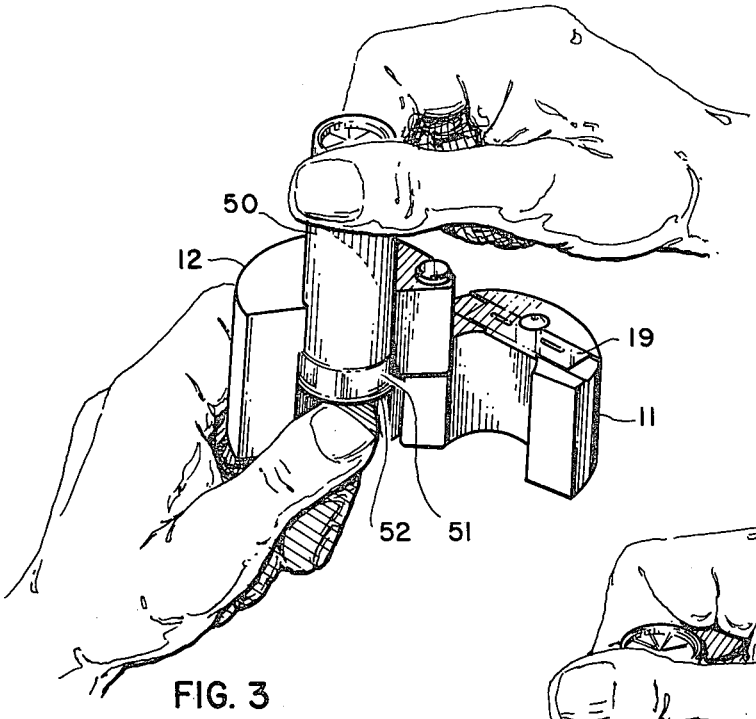
FIG. 3 is a pictorial representation of one step in the method of opening a loaded shotshell utilizing the apparatus shown in FIGS. 1 and 2.
Figure 4:
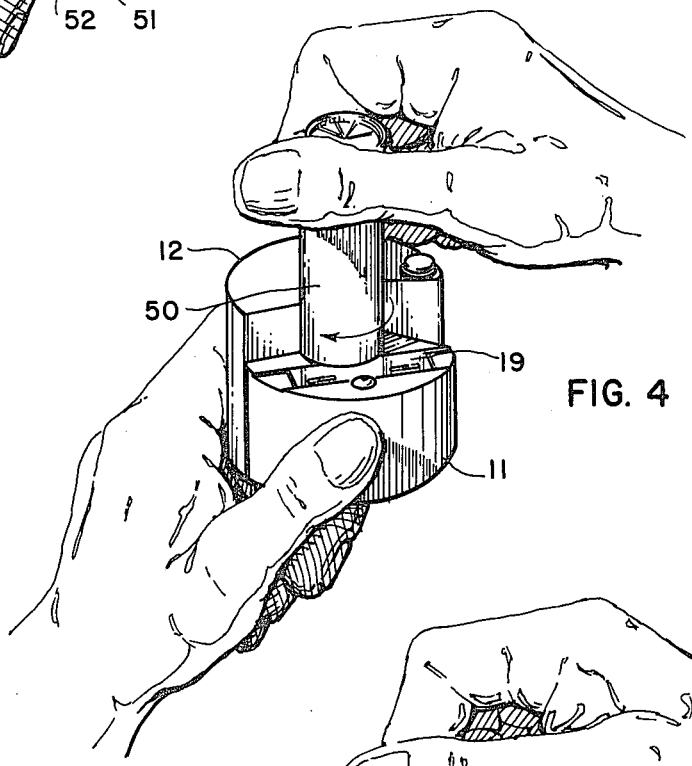
FIG. 4 is a pictorial representation of another step in the method for opening a loaded shell utilizing the apparatus shown in FIGS. 1 and 2.
Figure 5:
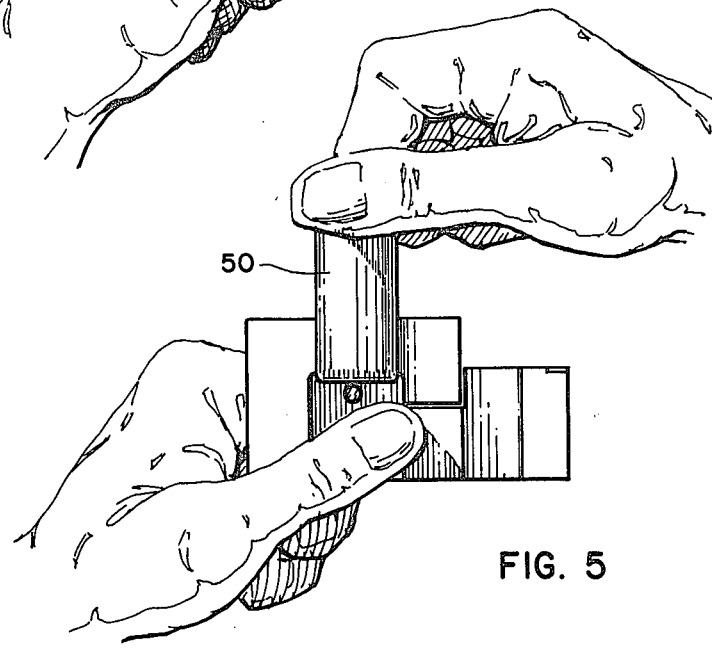
FIG. 5 is a pictorial representation of still another step in the method for opening a loaded shotshell utilizing the apparatus shown in FIGS. 1 and 2.

Referring to FIGS. 3, 4, and 5 a description of the operation of the opener can proceed sequentially as shown in these FIGS. First, the brass end 51 of a shotshell 50 to be cut off to recover the powder from the shotshell and to render it harmless is inserted into the bore 15. The shotshell is received in the opened tool so that the bore 15 will accomodate the flange 52 on the brass end of the shotshell and the semi-circular surface 16 of section 12 will pocket or receive the guage diameter of the body of the shotshell 50. The depth to which the brass end 51 of the shotshell 50 should be received into the bore 15 will vary depending on the structure of the shotshell being opened. For example, most shotshells with a base wad and uniformly dimensioned side walls can be located so that the cutting implement 19 engages the side wall material close to or near the upper termination of the brass end 51. Shotshells provided with a so-called continuous base cup generally have a side wall of increasing thickness nearer to the brass end which requires inserting such shotshells, such as Winchester-Western AA brand, deeper into the bore 15 to insure that the cutting implement will go completely through the side wall of the shotshell when the opener 10 is closed. After properly locating the shotshell in the opener 10 as shown, (in FIG. 3) and previously described, the opener 10 is then lightly closed, as shown in FIG. 4, to engage the body of the shotshells 50 against the surface 16 of the section 12 and the cutting implement 19, located on section 11. It is then preferable to manually apply closing pressure to the two hinged sections 11, and 12 as shown in FIG. 4 while manually rotating the exposed portion of the shotshell 50. If this step is accomplished while holding the open end of the opener over a suitable recepticle, then as the brass end 51 is severed from the body of the shotshell 50 by the cutting implement 19, the end 51 and the powder 54 (FIG. 6) can be recovered. The primer-containing brass end 51 can be recovered and the primer removed and reused if desired, and the uncontaminated powder can be used to prepare a new shotshell by returning it to a suitable powder recepticle. Depending on the pressure applied, the speed of rotation and the condition of the cutting implement 19 it may be necessary to use several rotations of the shotshell 50 to sever the brass end 51 from the shotshell. The crimped end of the shotshell 50 can then be removed if it is desired to recover the shot cup or wad 55 and lead or other shot 56. This is accomplished by again opening the opener 10, as shown in FIG. 5, moving the locating pin 31 into the bore 15 by pressing on the stop 33, inserting the crimped end of the shotshell into the bore 15 until it abutts the locating pin 31, closing the two sections 11 and 12 to engage the cutting implement 19 and rotating the body of the shotshell 50 while rotating to sever the crimped end. Again the shot can be recovered by holding the opener over a suitable receptical during the cutting operation.

Lastly the remaining portion of the original shotshell 50 after severing the brass end 51 and the crimped end 57, will contain the shot cup or wad 55. To recover this merely requires pushing it out of the portion 58. In shotshells having tapered walls it will be necessary to push the wad 55 out by applying force to the wad 55 from the brass end or base end of the portion 58 while holding that portion stationary.

Figure 6:
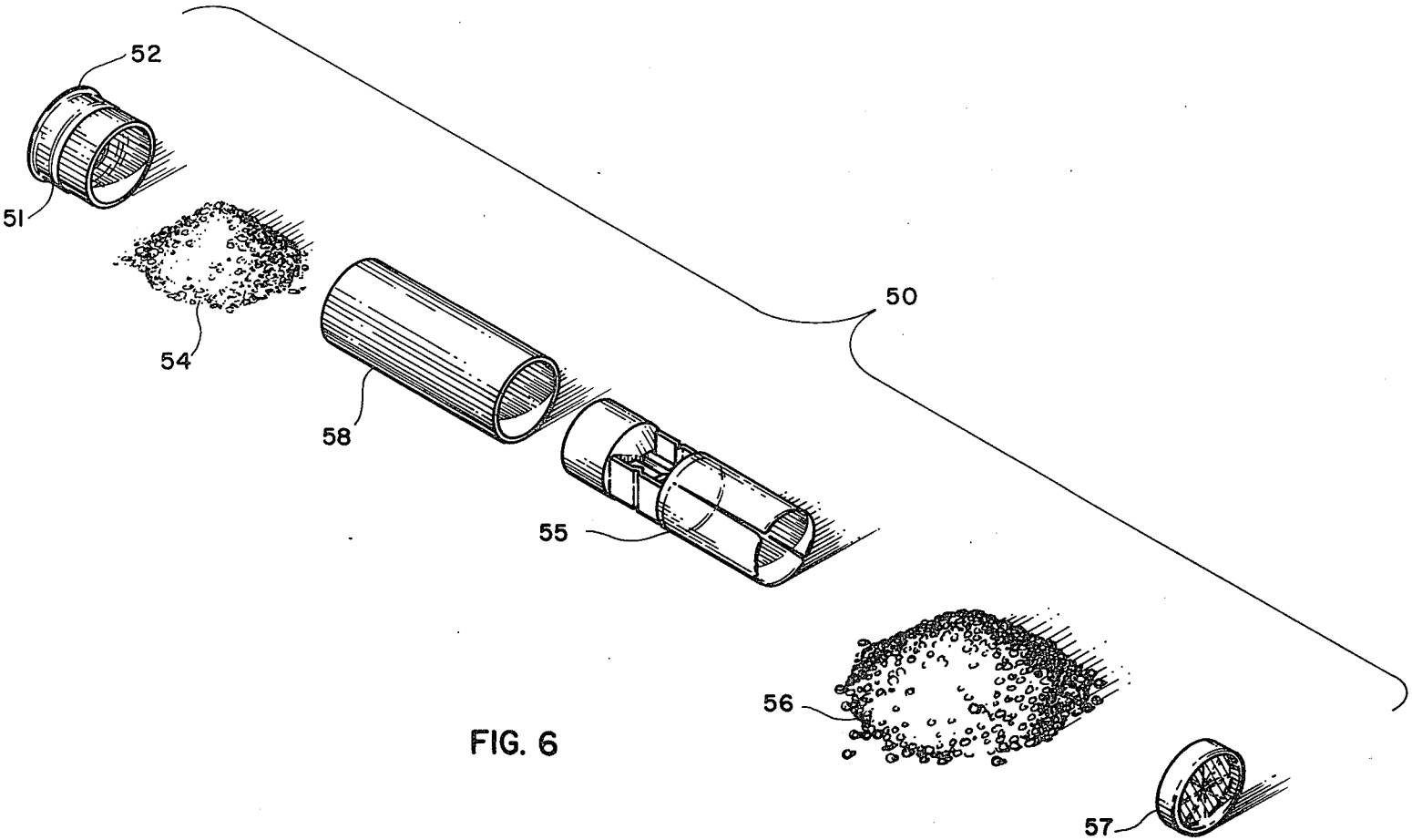
FIG. 6 is a pictorial representation of a shotshell opened by the apparatus and method of the present invention.

Referring to FIG. 6, the result of the operations, previously described, on a typical shotshell 50 are illustrated. The same or similar results can be obtained with shotshells that are made of cellulose fibers, plastic or the like. Indeed ammunition of different types can be opened by the apparatus and method of the present invention by providing different suitable cutting implements which can open the case of the ammunition with safety.

It will be appreciated from the foregoing that the opener and method of the present invention, when appropriately sized, can be adapted for use with any guage of shotshell or caliber. Likewise, the type of cutting implement or composition of materials used can be varied and still in the same manner accomplish the results described herein. For example, plastics, metals, or even ceramics can be used for any of the components described without departing from the spirit or scope of the appended claims.

I claim:

1. A device for cutting open plastic or paper-walled shot shell ammunition comprising:

a plurality of rotatably connected semicylindrical body portions where at least one of said body portions extends axially beyond the other said body portion, said body portions being movable to define a first open position and a second closed position and when in the second closed position define a first bore therethrough, said one body portion containing at least two semicircular surfaces defining said first cylindrical bore of a predetermined diameter and a second cylindrical bore of a predetermined diameter smaller than the diameter of said first cylindrical bore, said second cylindrical bore being established on at least a portion of the extension of said one body portion, cutting means located on one of said body portions positioned so that when said body portions are in the closed position, the cutting means extends into said second cylindrical bore a sufficient depth to cut through the wall of a shot shell placed in said second cylindrical bore, whereby a shotshell can be opened when inserted into said second cylindrical bore and rotated after closing said body portions.

2. The device of claim 1 wherein said cutting means is located on one of the body portions defining said first cylindrical bore.

3. The device of claim 2 wherein one of said body portion defining said first cylindrical bore in addition comprises a second bore generally perpendicular to said first cylindrical bore which contains means for intermittently interfering with the insertion of ammunition into said bore.

4. The device of claim 3 wherein the first cylindrical bore is sized to receive the flanged portion of a shot shell of preselected guage or calibre.

5. The device of claim 4 wherein the semicircular surface defining the first cylindrical bore is slightly larger than a shotshell.

6. The device of claim 5 wherein the cutting means is located on the body portion defining only said first cylindrical bore.

7. The device of claim 6 wherein each of said body portions are coaxially hinged about each other.

8. A method for opening ammunition comprising the steps of:

Rotating the ammunition axially about its diameter in a generally cylindrical openable chamber having a diameter greater than said ammunition, closing the chamber to define a bore of only slightly larger diameter than the ammunition while rotating the ammunition into a cutting implement projecting into the chamber, until the body of the case of ammunition is severed.

* * * * *